United States Patent [19]

Karlsson

[11] Patent Number: 4,795,203

[45] Date of Patent: Jan. 3, 1989

[54] CONTAINER AND TRAILER HANDLING COMBINATION YOKE DEVICE WITH IMPROVED ELEVATED STORAGE FOR LIFTING ARMS

[76] Inventor: Gösta Karlsson, Skogsgatan 6, S-280 72 Killeberg, Sweden

[21] Appl. No.: 102,568

[22] Filed: Sep. 29, 1987

[30] Foreign Application Priority Data

Sep. 30, 1986 [SE] Sweden ..... 8604144

[51] Int. Cl.[4] ..... B66F 9/18

[52] U.S. Cl. ..... 294/81.51; 414/607

[58] Field of Search ..... 294/81.51, 67.1, 68.1, 294/67.31, 67.32, 683, 81.1; 414/607, 608

[56] References Cited

U.S. PATENT DOCUMENTS 4,014,447 3/1977 Whiteman et al. ..... 414/607

FOREIGN PATENT DOCUMENTS 1557373 1/1969 France ..... 294/81.51

*Primary Examiner*—James B. Marbert

*Attorney, Agent, or Firm*—Cushman, Darby & Cushman

[57] ABSTRACT

A container and trailer-handling combination yoke having lifting arms mounted at the opposite ends of two transversely extending, longitudinally spaced yokes interconnected by a telescopically extensible frame, are mounted for pivoting between respective generally vertical, operating positions and generally horizontal elevated positions. The arms are mounted to the respective yoke ends via respective intermediate members which are themselves pivotally mounted to the yokes about respective generally horizontal, longitudinally extending axes, so that the elevated arms may be swung inboard to storage positions lying transversely inboard of the respective ends of the yokes. Preferably, hydraulic double cylinders are used for swinging-up the lifting arms.

4 Claims, 2 Drawing Sheets

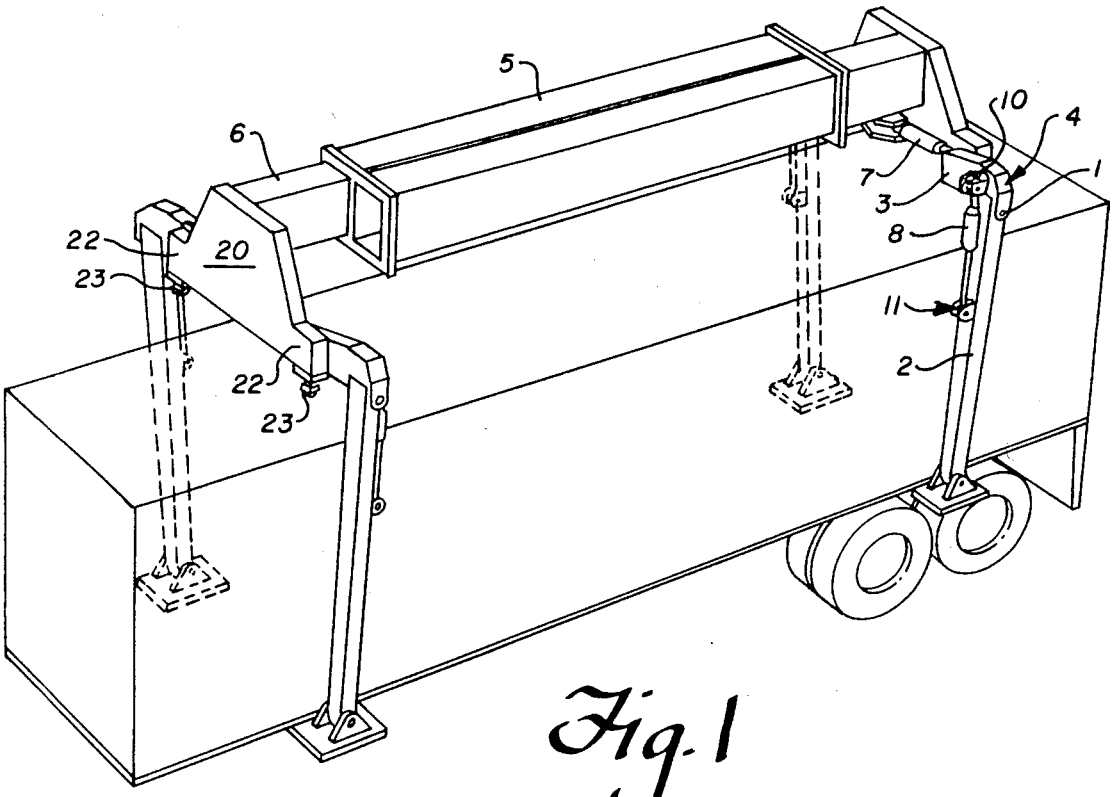
Fig. 1
Fig. 2
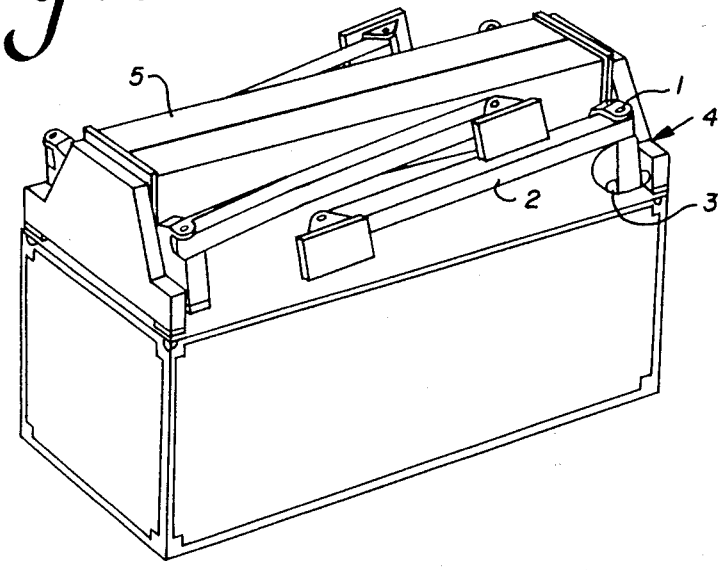

CONTAINER AND TRAILER HANDLING COMBINATION YOKE DEVICE WITH IMPROVED ELEVATED STORAGE FOR LIFTING ARMS

BACKGROUND OF THE INVENTION

The invention relates to a device for swinging the lifting arms of a container and trailer-handling combination yoke device upwards, and transfer thereof to a position inside the perimeter of an imaginary rectangular figure resulting from drawing imaginary lines joining the laterally outer ends of respective the long sides of the yoke means of the device, when containers and trailers are being handled. Such a location of the lifting arms of the combination yoke device inside the long sides of the yoke means is of the greatest importance when using the yoke means for handling containers, during which the yoke means supports the container at each of the four corners of the top of the container by means of so-called twist locks, especially in the case when a close arrangement of containers in, for example cargo terminals is desired for space reasons, which has, of course, great economic advantages.

A device of this type is already known. In the known device, the lifting arms are first swung upwards by means of a conventional hydraulic cylinder, the piston rod of which is attached to the lifting arm and the cylinder of which is attached to an intermediate piece in which the arm is pivotably suspended, to a substantially horizontal position, after which the intermediate piece, with the upwardly swung arm and the hydraulic cylinder, is pulled-in to a position inside the long side of the yoke means, by means of another conventional hydraulic cylinder arranged on a stationary transverse beam included in the frame in which a movable beam is arranged telescopically, said intermediate piece being attached to said movable beam.

A disadvantage of this known device is that the lifting arms in an upwardly swung, pulled-in position will not remain in this position due to the fact that the hydraulic cylinders has a tendency to leak of hydraulic liquid, allowing the arms to sink from their horizontal position.

This sinking which, moreover, is accelerated by the violent movements of the yoke means in handling and, of course, may be as great for different arms, may result in the lifting arms getting in contact with one another and sometimes, moreover, to hook to and lock each other and, which is very common, the lifting arms knocking a hole in the container or the trailer which, for example, in a following rain may have devastating effects on the contents of the container or trailer. Such damage to the container or trailer must be repaired immediately-resulting in a stoppage of the handling work which, consequently, involves losses of both time and money.

Another disadvantage is the bad moderation of the swinging movements of the lifting arms in the longitudinal direction of the yoke means, for example due to an unevenly distributed load in the container or inexact operation of the yoke means caused by the conventional single piston-type hydraulic cylinders of the lifting arms in handling which may result in a displacement of the load, damage to the load in the case of a fragile load or to the very yoke means, trailer and container.

SUMMARY OF THE INVENTION

Consequently, it is the object of the present invention to provide a means for swinging lifting arms of such a combination yoke device upwards and for transferring the lifted arms to a position inside the long sides of the yoke means, when containers or trailers are being handled, said device eliminating the disadvantages in the known devices described above.

This object is achieved by means of the device according to the invention which is characterized in that it comprises a first shaft for swinging the lifting arm upwards from a vertical position to a substantially horizontal one and back, and a second, substantially horizontal shaft around which the first shaft is pivotable, together with the lifting arm, for swinging in and out, transversally of the longitudinal axis of the device, the upwardly-swung, substantially horizontal shaft to a position inside and outside, respectively, the long side of the yoke means.

The device is characterized, moreover, in that the first shaft is inclined somewhat downwards relative to the horizontal plane to the right or to the left, when the associated lifting arm is in its swung-up, swung-out position, that the second shaft is inclined somewhat downwards or upwards relative to the horizontal plane, or that both the first and second shafts are horizontal, that the first shaft and the second shaft are arranged substantially perpendicularly to each other, that the first shaft connects the lifting arm with an intermediate piece and that the second shaft connects the intermediate piece with the yoke means pivotably.

Furthermore, the lifting arms can be arranged at the ends of a frame included in the yoke means or at the ends of the transverse beams of the yoke means.

For swinging up the lifting arm and swinging in the intermediate piece and the lifting arm the device of the invention preferably comprises a hydraulic double cylinder, one piston rod of which is connected to the intermediate piece and the other piston rod with the lifting arm, and a hydraulic cylinder connecting the intermediate piece with the yoke means.

BRIEF DESCRIPTION OF THE DRAWINGS

The invention is described below in greater detail in the form of an example with reference to the attached drawings, wherein FIG. 1 is a schematic perspective view of the device of the invention when handling a trailer, the carrying arms being shown in a swung-down, operating position, FIG. 2 is a schematic perspective view of the device of the invention when handling a container, the carrying arms being shown in a swung-up, swung-in stowed (stored) position

DETAILED DESCRIPTION OF A PREFERRED EMBODIMENT

Figure 3:
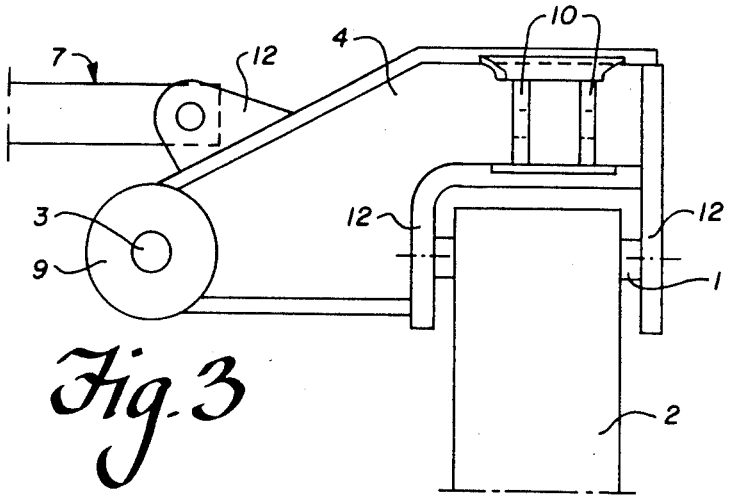
FIG. 3 is a schematic enlarged scale, fragmentary end elevational view of the intermediate piece of the device of the invention and shows how the piston rod of the hydraulic cylinder and the lifting arm are connected to this intermediate piece.

As is apparent from the drawings, especially FIGS. 1 and 3, the device of the invention comprises horizontal, longitudinally-extending frame, in the opposite ends of respective channels of which respective longitudinal beams 6 are telescopically received for greater and lesser extension (as shown in FIG. 1), and retraction (as shown in FIG. 2). At its outer end, each longitudinal beam mounts a respective transversally extending beam or yoke 20, having outer ends 22. Each yoke is shown provided with elements 24 for engaging a trailer or container for effecting handling. The device further comprises at each end of each yoke 20, an intermediate piece 4 with a first shaft 1 fixedly mounted therein, to which a lifting arm 2 of the device is mounted and around which that lifting arm can be swung upwards, from being generally vertical to being generally horizontal, so as to become substantially in parallel with the longitudinal axis of the device. The raising of the lifting arms is effected by pivotal movement of the lifting arms around the longitudinal axes of the respective first shafts 1, at a time when the first shafts are disposed generally horizontally and transversally of the longitudinal axis of the device, at the upper ends of the lifting arms, each position by means of a respective hydraulic double cylinder 8, i.e., a piston-cylinder unit having a cylinder from which two independently extensible-retractable pistons extend in axially opposite directions. When the lifting arms are arranged vertically, as shown in FIG. 1, one piston rod of each unit 8 is an upper one, and the other is a lower one. In each unit, the upper piston rod is articulatedly connected to a pair of lugs 10 on the respective intermediate piece and the respective lower piston rod is articulatedly connected with a pair of lugs 11 on the respective lifting arm 2. Each intermediate piece 4 comprises further a sleeve 9 in which a second, substantially horizontal shaft 3, attached to the respective yoke end 22 is received, and around which the respective intermediate piece 4 with the respective lifting arm in a substantially horizontal position, can be swung medially, inwards (in relation to the longitudinal axis of the frame 5) into the position shown in FIG. 2 by means of a respective conventional hydraulic cylinder 7, the piston rod end of which is rotatably connected to a second pair of lugs 12 on the respective intermediate piece.

As mentioned above, both the first shafts 1 and the second shafts 3 are generally horizontal when the lifting arms are in their respective generally vertical, operating positions. It should be understood by this that the first shaft can be somewhat inclined downwards relative to horizontal to the right or to the left or that the second shaft can be inclined somewhat upwards or downwards relative to horizontal. Of course, the two shafts 1 and 3 can also be substantially horizontal, one lifting arm on each side lying transversally inside the other lifting arm on the same side of the device, in the same horizontal plane. In order that the lifting arms 2, when disposed in an upwardly swung position might be swung in at each long side of the yoke means, in a spaced relationship, the second shafts 3 at one end of one yoke means 20 at both ends 22 thereof at one end of the device, for example, can thus be mounted so that they are somewhat inclined downwards from the horizontal plane and at the other end of the device both ends 22 of the yoke 20 the second shafts 3 may be mounted the yoke means so that they are inclined somewhat upwards from the horizontal plane (see FIG. 2).

If each intermediate piece 4 is swung inwards to such a position that the respective shaft 1 is vertical, there is no turning point around which the respective lifting arm, upon the occasion of leakage of hydraulic liquid from the respective double cylinder 8, can turn and, consequently, by the device of the invention sinking of the lifting arm and the associated damage described above in connection with the prior art device are eliminated by means of the device of the invention. However, each first shaft 1 is, in the preferred embodiment, inclined in its final position, as shown in FIG. 2, somewhat inwards from the vertical plane against the yoke means and consequently the lifting arms and the intermediate pieces will exert a torsional movement about the second shafts 3 in this position. However, the small torsional movement concerned here is absorbed by the hydraulic cylinders 7, the pistons of which are quite retracted in this position.

Figure 4:
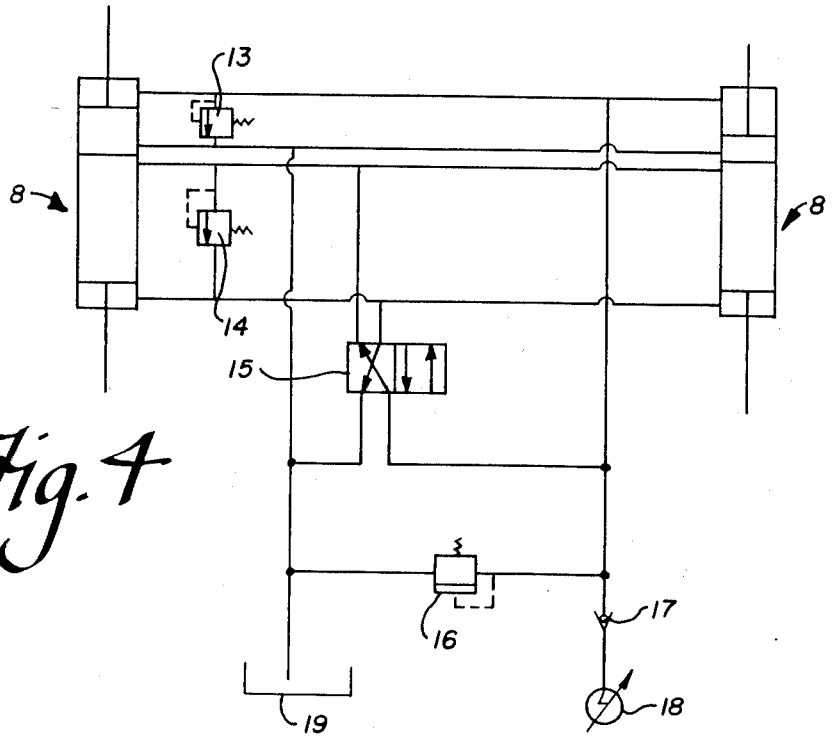
FIG. 4 is a schematic diagram of the hydraulic double cylinder with its associated control circuit used in the device of the invention.

The above-mentioned double cylinder 8 shown in FIG. 4 is used with the device of the invention instead of a conventional hydraulic cylinder primarily to improve damping of the tensile forces arising in the course of the upwardly-directed pivotal movements of the arms, which can bring several problems as mentioned in the introductory portion of the specification. In principle, each double cylinder 8 has three positions, viz both pistons retracted, the upper piston retracted and the lower piston pushed out and both pistons pushed out. In the present case only the two first positions are used. In the first position the respective lifting arm is in an upwardly-swung, substantially horizontal position and in the second position, each lifting arm 2 is in its vertical lifting position (FIGS. 1 and 4). Damping can be effected in the following way: at an inwardly directed pivotal motion of the lifting arm the double cylinder will be exposed to a compression force that is damped by the lower piston as in a usual hydraulic cylinder with a piston, while the double cylinder at an outwardly directed pivotal motion of the lifting arm, i.e. in a direction towards the end section of the yoke means, will be exposed to a tensile force that is damped by the upper cylinder. A preferred control circuit, shown used with the two double cylinders in FIG. 4 comprises the following components: two adjustable overflow valves 13, 14, a directional valve 15, a safety valve 16, a non-return valve 17, a pump 18, a tank 19 and conduits for the hydraulic liquid. The fundamental structure of the control circuit is, of course, the same independently of the number of double cylinders. Thus, by using a double cylinder, damping of the tensile forces at the outward motion of the lifting arm is also achieved in addition to the usual damping of the compression forces at the inward motion of the lifting arms. This is not without importance, as the motion forces can amount to 100,000N and more.

Thus, by means of the device of the invention, both a more efficient utilization of the storage surfaces of the cargo terminals and a safer handling of trailers both for humans and surroundings can be obtained.

I claim:

1. A container and trailer-handling combination yoke device, comprising:

a frame having a generally horizontal longitudinal axis and two opposite ends;

a pair of transversally extending yokes supported at opposite ends of said frame, each yoke having two transversally-opposite ends having transversally outer extents from said longitudinal axis;

each yoke including means for engaging a container or trailer for handling the container or trailer;

four lifting arms each having two opposite ends;

respective means pivotally securing each said lifting arm, by a respective one end thereof, to a respective said yoke end for pivotal movement between:

a lowered, operating position in which such lifting arm is disposed generally vertically with said one end thereof disposed above the opposite end thereof, and an elevated position in which such lifting arm is disposed generally horizontally and extends generally parallel to said longitudinal axis of said frame;

each said pivotal securing means including:

an intermediate piece;

a first rotary joint pivotally securing a respective said lifting arm to said intermediate piece, for rotation about an axis which extends generally horizontally and generally transversally of said device when the respective said lifting arm is in said lowered, operating position; and a second rotary joint pivotally securing said intermediate piece to a respective said end of a respective said yoke, for rotation about an axis which extends generally horizontally and generally longitudinally of said device, whereby, after said lifting arms have been swung-up about said first rotary joints from said operating positions to said elevated positions thereof, said lifting arms and said intermediate pieces may be swung inwards about said second rotary joints to respective stored positions in which said lifting arms remain generally horizontal and generally parallel to said longitudinal axis of said device but said lifting arms are located further inboard, in relation to said longitudinal axis, than when said lifting arms are disposed in said elevated position;

said lifting arms when disposed in said stored positions thereof being disposed axially between said yokes and transversally closer to said longitudinal axis than are said transversally outer extents of said ends of said yokes.

2. The container and trailer-handling combination yoke device of claim 1, further including:

first hydraulic piston and cylinder means articulatedly connected between each said lifting arm and the respective said intermediate piece, for rotating said lifting arms about said axes of said first rotary joints; and second hydraulic piston and cylinder means articulatedly connected between each said intermediate piece and the respective said end of the respective said yoke, for rotating said intermediate pieces and lifting arms together about said axes of said second rotary joints.

3. The container and trailer-handling combination yoke device of claim 2, wherein:

said first hydraulic piston and cylinder means each comprise a cylinder telescopically mounting two axially oppositely-extending, independently extensible-retractable pistons, one said piston being articulately connected to a respective said lifting arm and another said piston being articulatedly connected to a respective said intermediate piece.

4. A container and trailer-handling combination yoke device, comprising:

a frame having a generally horizontal longitudinal axis and two opposite ends;

a pair of transversally extending yokes supported at opposite ends of said frame, each yoke having two transversally-opposite ends having transversally outer extents from said longitudinal axis;

each yoke including means for engaging a container or trailer for handling the container or trailer;

four lifting arms each having two opposite ends;

respective means pivotally securing each said lifting arm, by a respective one end thereof, to a respective said yoke end for pivotal movement between:

a lowered, operating position in which such lifting arm is disposed generally vertically with said one end thereof disposed above the opposite end thereof, and an elevated position in which such lifting arm is disposed generally horizontally and extends generally parallel to said longitudinal axis of said frame;

each said pivotal securing means including:

an intermediate piece;

a rotary joint pivotally securing a respective said lifting arm to said intermediate piece, for rotation about an axis which extends generally horizontally and generally transversally of said device when the respective said lifting arm is in said lowered, operating position; and whereby, said lifting arms may be swung-up about said first rotary joints from said operating positions to said elevated positions thereof, hydraulic piston and cylinder means articulatedly connected between each said lifting arm and the respective said intermediate piece, for rotating said lifting arms about said axes of said rotary joints;

said hydraulic piston and cylinder means each comprise a cylinder telescopically mounting two axially oppositely-extending, independently extensible-retractable pistons, one said piston being articulately connected to a respective said lifting arm and another said piston being articulatedly connected to a respective said intermediate piece.

* * * * *